US008814603B2

(12) United States Patent
Chang et al.

(10) Patent No.: US 8,814,603 B2
(45) Date of Patent: Aug. 26, 2014

(54) SHIELDING SOCKET WITH TWO PIECES CONTACTS AND TWO PIECES HOUSING COMPONENTS

(71) Applicant: Hon Hai Precision Industry Co., Ltd., New Taipei (TW)

(72) Inventors: Yen-Chih Chang, New Taipei (TW); Tzu-Yao Hwang, New Taipei (TW); Wei-Hung Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/830,620

(22) Filed: Mar. 14, 2013

(65) Prior Publication Data

US 2014/0038465 A1 Feb. 6, 2014

(30) Foreign Application Priority Data

Aug. 2, 2012 (TW) ..... 101127874

(51) Int. Cl.
*H01R 24/00* (2011.01)

(52) U.S. Cl.
USPC ..... 439/626

(58) Field of Classification Search
CPC .. H01R 12/52; H01R 13/648; H01R 13/6586; H01R 13/65802; H01R 23/6873
USPC ..... 439/607.01, 66, 108, 83, 342, 857, 856, 439/626, 630
See application file for complete search history.

(56) References Cited

U.S. PATENT DOCUMENTS

| | | | | |
|---|---|---|---|---|
| 7,537,461 | B2 * | 5/2009 | Rathburn | 439/66 |
| 7,674,113 | B2 * | 3/2010 | Di Stefano | 439/66 |
| 7,845,955 | B2 * | 12/2010 | Nakayama et al. | 439/66 |
| 2008/0194124 | A1 * | 8/2008 | Di Stefano | 439/66 |

FOREIGN PATENT DOCUMENTS

| | | |
|---|---|---|
| TW | M419248 | 12/2011 |

* cited by examiner

*Primary Examiner* — Edwin A. Leon
(74) *Attorney, Agent, or Firm* — Wei Te Chung; Ming Chieh Chang

(57) ABSTRACT

An electrical connector for electrically connecting a chip module with a printed circuit board includes an upper component, a lower component assembled on the upper component and a number of terminals, the upper component includes a number of upper tabs and the lower component includes a number of lower tabs. The terminals include a number of upper terminals and a number of lower terminals matched with the upper terminals. The upper terminals received in the upper component and the lower terminals received in the lower component; wherein the pressing of the terminal can transform the vertical movement of the upper terminal to the horizontal movement of the lower terminal.

20 Claims, 8 Drawing Sheets

SHIELDING SOCKET WITH TWO PIECES CONTACTS AND TWO PIECES HOUSING COMPONENTS

BACKGROUND OF THE INVENTION

1. Field of the Invention

The present invention relates to an electrical connector, and more particularly to an electrical connector mounted to a printed circuit board for receiving an Integrated Circuit package.

2. Description of the Prior Art

As the "Nonlinear Analysis Helps Design LGA Connectors" (Connector Specifier, February 2001) show, an electrical connector includes a base and a number of contacts assembled in the base. Each of the contacts defines an upper contacting point for contacting with a CPU and a lower contacting point for contacting with a printed circuit board, and it forms the signal transmission between the CPU and the printed circuit board. With the development of the electronic technology, the size of the electrical connector becomes smaller and smaller, but the density of the pads of the CPU and the density of the pads of the printed circuit board become larger and larger. So, the electromagnetic interference between the adjacent contacts becomes serious and it affects the quality of the signal transmission between the CPU and the printed circuit board.

An electrical connector electrically connecting a chip module to a printed circuit board is described in Tai Wan Patent No. M419,248, issued to CHANG et al. on Dec. 21, 2011. The electrical connector includes a socket body with a plurality of electrical contacts secured therein. The socket body has a top surface, a low surface opposite to the top surface and a number of grooves penetrate from the top surface to the low surface. Each of the grooves includes a first groove and a second groove. The contacts secured in the first grooves respectively. The electrical connector further includes a metal shielding plate assembled in the second groove. Due to the contacts extending outwardly from the top surface and after the contacts being compressed, the space of the adjacent pads of the chip module is full filled by the contacting portion of the contacts and it affects the performance of the electrical connector, so it is not benefit to the electromagnetic shielding performance of the electrical connector.

Therefore, it is needed to find a new electrical socket to overcome the problems mentioned above.

SUMMARY OF THE INVENTION

Accordingly, an object of the present invention is to provide an electrical connector with a simple structure and can get better shielding result.

In order to achieve the object set forth, an electrical connector for electrically connecting a chip module with a printed circuit board comprises an upper component, a lower component assembled on the upper component and a plurality of terminals, the upper component comprises a plurality of upper tabs and the lower component comprises a plurality of lower tabs. The terminals comprise a plurality of upper terminals and a plurality of lower terminals matched with the upper terminals. The upper terminals received in the upper component and the lower terminals received in the lower component, wherein an area that the upper tab contacts with the lower tab is plated with a metal layer.

DESCRIPTION OF PREFERRED EMBODIMENT

Figure 1:
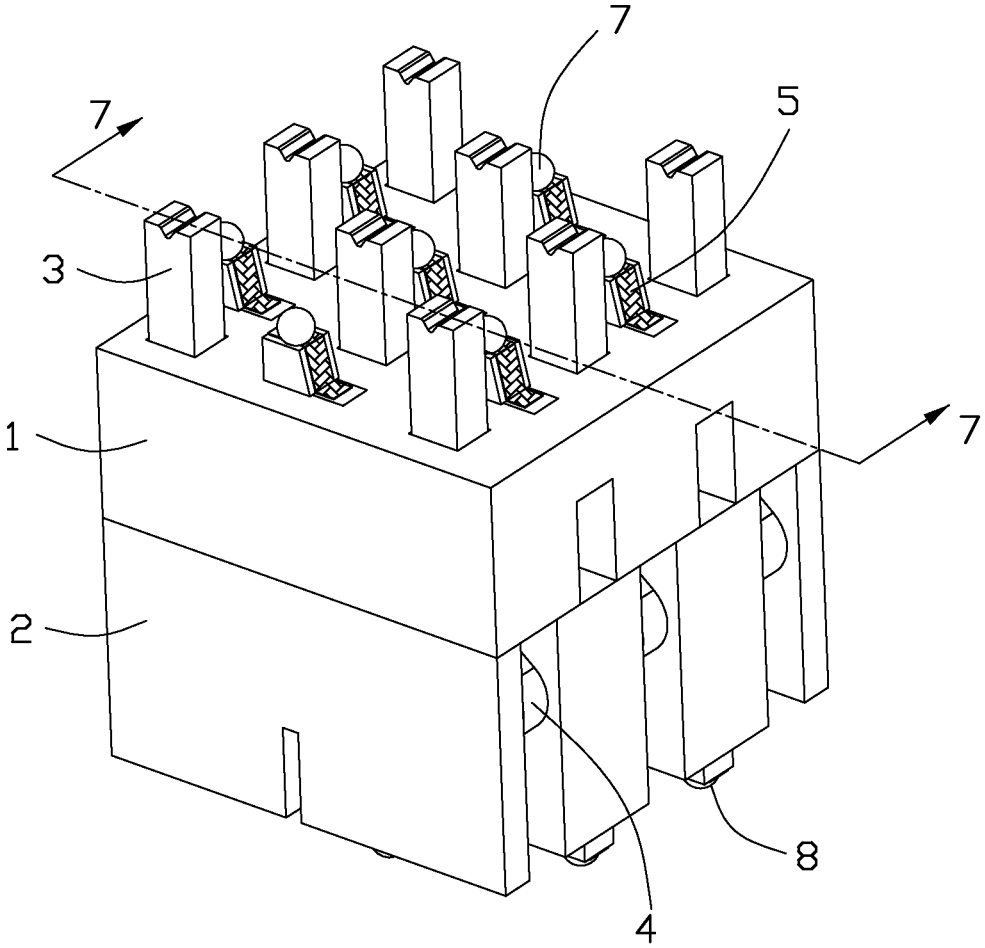
FIG. 1 is an isometric, assembled view of an electrical connector with a plurality of grounding elements in accordance with a preferred embodiment of the present invention.
Figure 2:
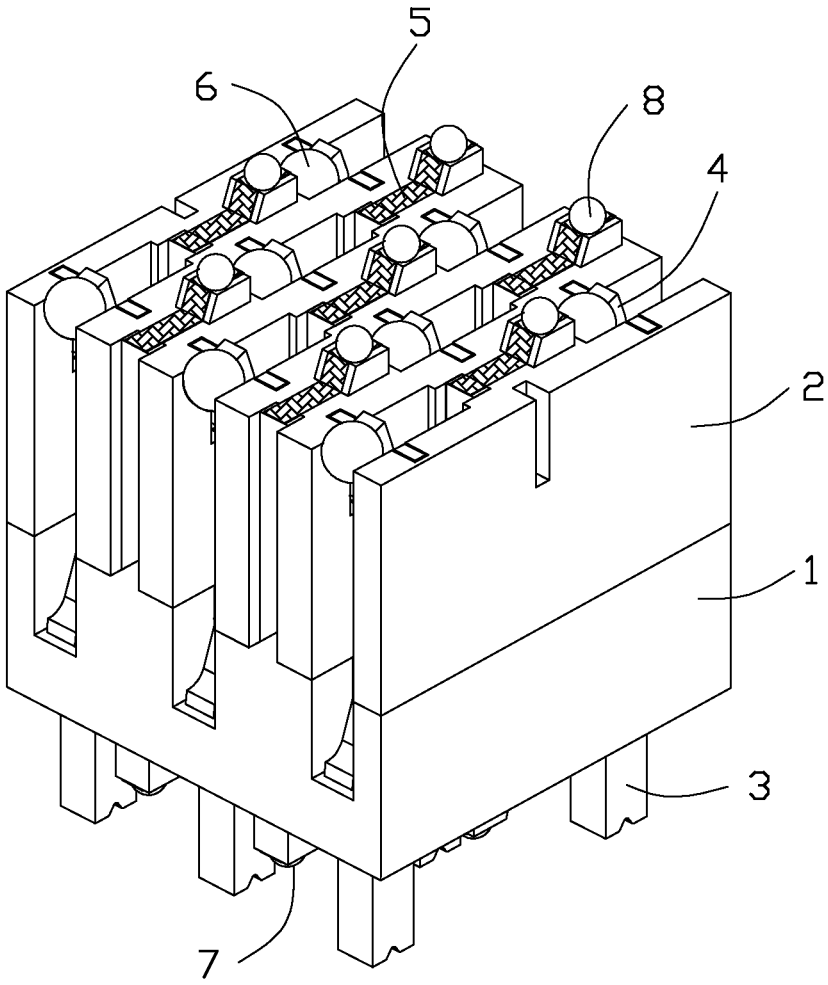
FIG. 2 is another isometric, assembled view of the electrical connector with a plurality of grounding elements as shown in FIG. 1.
Figure 3:
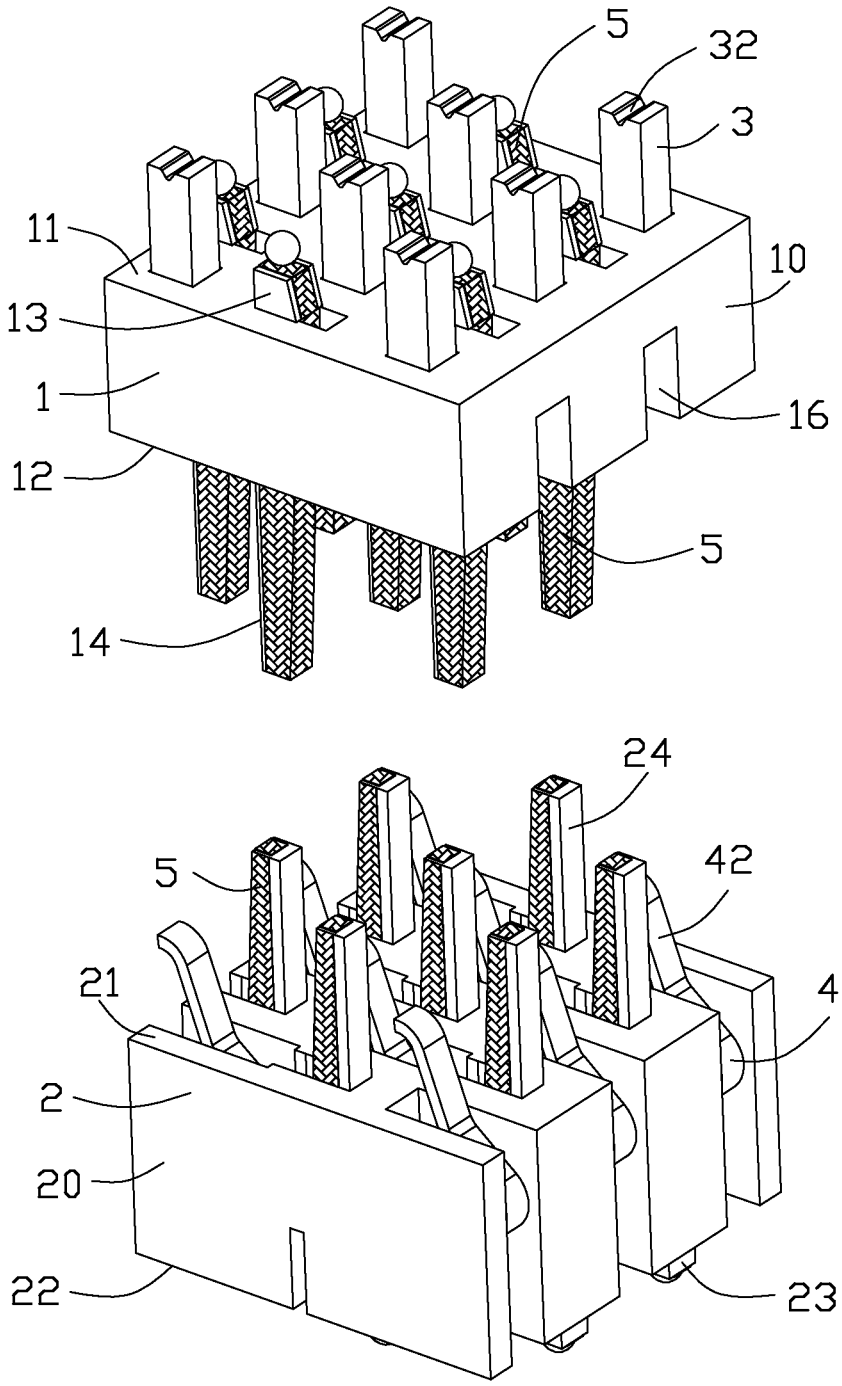
FIG. 3 is an exploded view of the electrical connector with a plurality of grounding elements as shown in FIG. 1.
Figure 4:
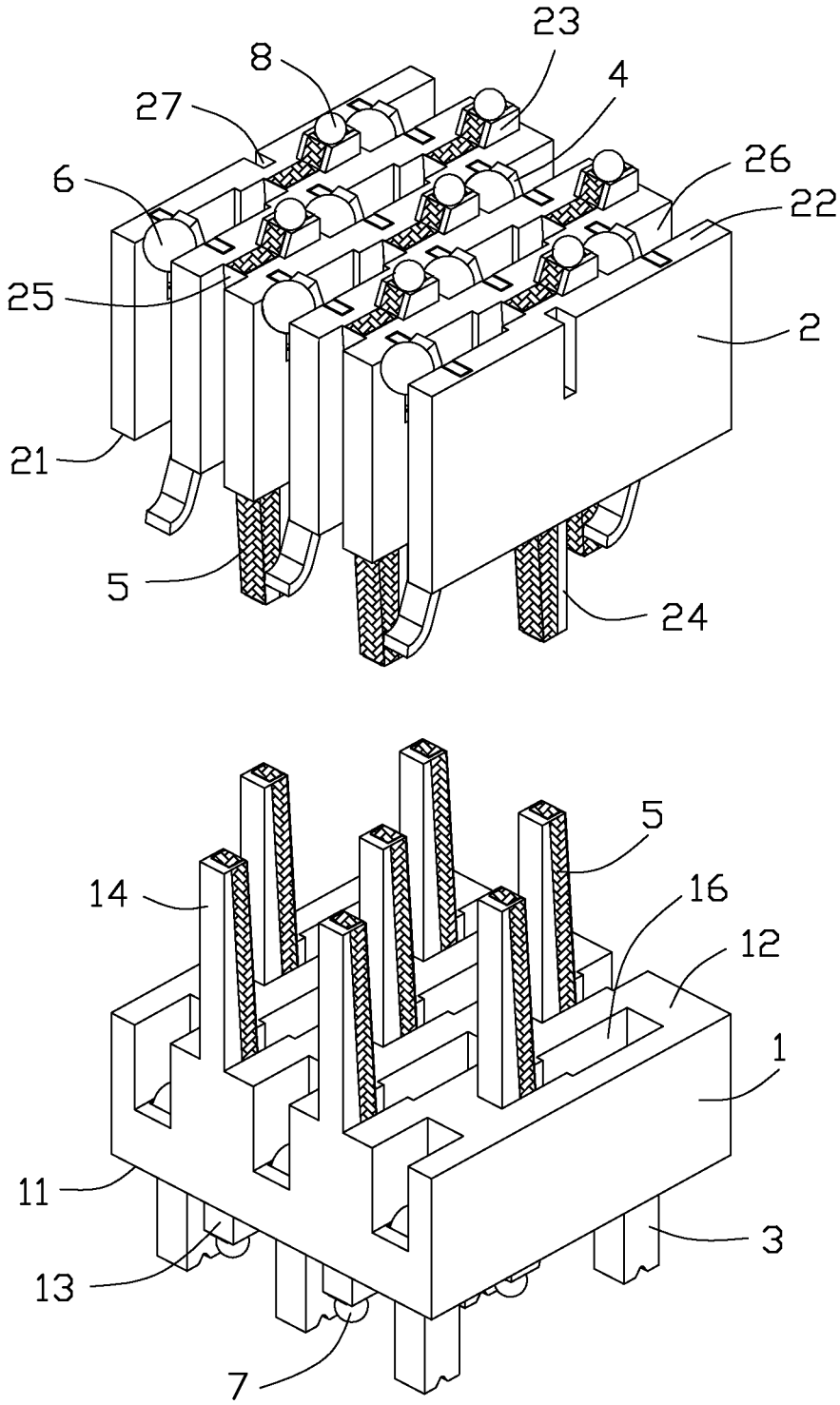
FIG. 4 is another exploded view of the electrical connector in FIG. 3.

Reference will now be made to the drawings to describe the present invention in detail.

Referring to FIGS. 1-4, an electrical connector 100 according to the present invention is used for electrically connecting a chip module to a printed circuit board. The electrical connector 100 comprises an insulative housing (not labeled), a plurality of terminals received therein and a plurality of solder balls 6 used to be soldered to the printed circuit board. The insulative housing comprises an upper component 1 and a lower component 2 stacked on the upper component 1. Each of the terminals comprises an upper terminal 3 and a lower terminal 4 matched with the upper terminal 3. The electrical connector 100 further comprises a plurality of first solder balls 7 assembled on the chip module and a plurality of second solder balls 8 assembled on the printed circuit board.

Referring to FIGS. 3-6, the upper component 1 is made of insulating material and comprises a first base 10. The first base 10 comprises a top surface 11, a bottom surface 12 opposite to the top surface 11, a plurality of upper receiving slots 16 depressed from the bottom surface 12, a plurality of terminal receiving passageways 17 depressed from the top surface 11. Each of the terminal receiving passageways 17 is communicated with one upper receiving slot 16 and the first base 10 also comprises a plurality of receiving holes 18 penetrated from the top surface 11 to the bottom surface 12 and each of the receiving holes 18 is communicated with one upper receiving slot 16. Each of the upper terminals 3 is received in one terminal receiving passageway 17 and one upper receiving slot 16 respectively. The lower terminals 4 are received in the upper receiving slots 16 respectively. The upper component 1 also comprises a plurality of upper tabs (not labeled) and each of the upper tabs comprises a first tab 13 protruding from the top surface 11, a second tab 14 protruding from the bottom surface 12 and an upper connecting portion 15 connects the first tab 13 with the second tab 14. An area of the upper connecting portion 15 exposed in the receiving hole 18 is plated with a metal layer 5. The metal layer 5 extending upwardly to cover the first tab 13 partly and extending downwardly to cover the second tab 14 partly. The length of the second tab 14 is larger than that of the first tab 13 so as to match with the lower component 2.

The lower component 2 is made of insulating material and comprises a second base 20. The second base 20 comprises an upper surface 21, a lower surface 22 opposite to the upper surface 21 and a plurality of lower receiving slots 26 penetrated from the upper surface 21 to the lower surface 22. The lower terminals 4 are also received in the receiving slots 26 respectively. The lower component 2 also comprises a plurality of retention slots 27 communicated with the lower receiving slots 26 respectively for securing the lower terminals 4. The lower component 2 further comprises a plurality of lower tabs (not labeled) and each of the lower tabs comprises a third tab 23 protruding from the lower surface 22, a fourth tab 24 protruding from the upper surface 21 and a lower connecting portion 25 connects the third tab 23 with the fourth tab 24. An area of the lower connecting portion 25 exposed in the lower receiving slot 26 is plated with the metal layer 5. The metal layer 5 extending downwardly to cover the third tab 23 partly and the metal layer 5 extending upwardly to cover the fourth tab 24 partly. The length of the fourth tab 24 is larger than that of the third tab 23 so as to match with the upper component 1.

Figure 5:
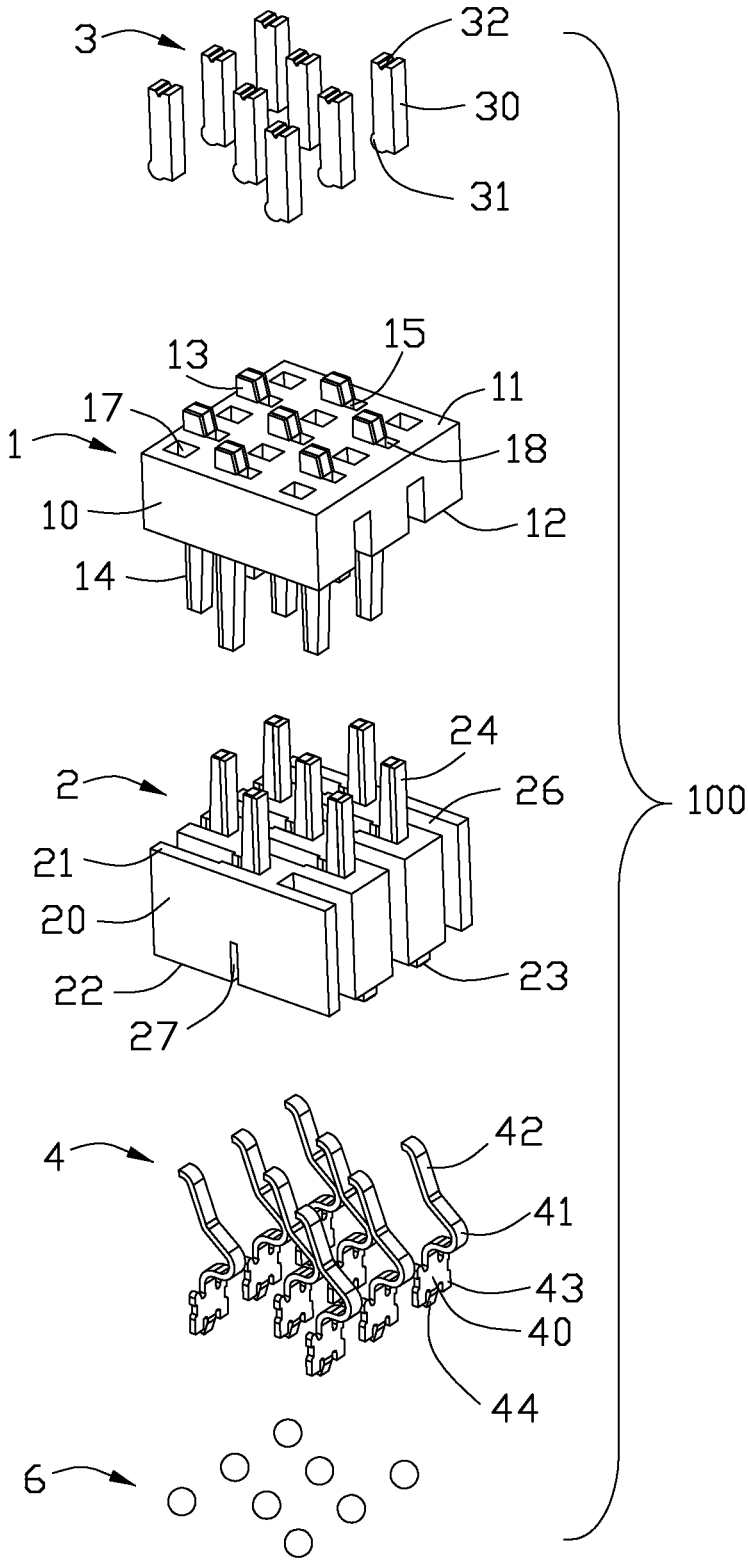
FIG. 5 is an exploded view of the electrical connector as shown in FIG. 1.
Figure 6:
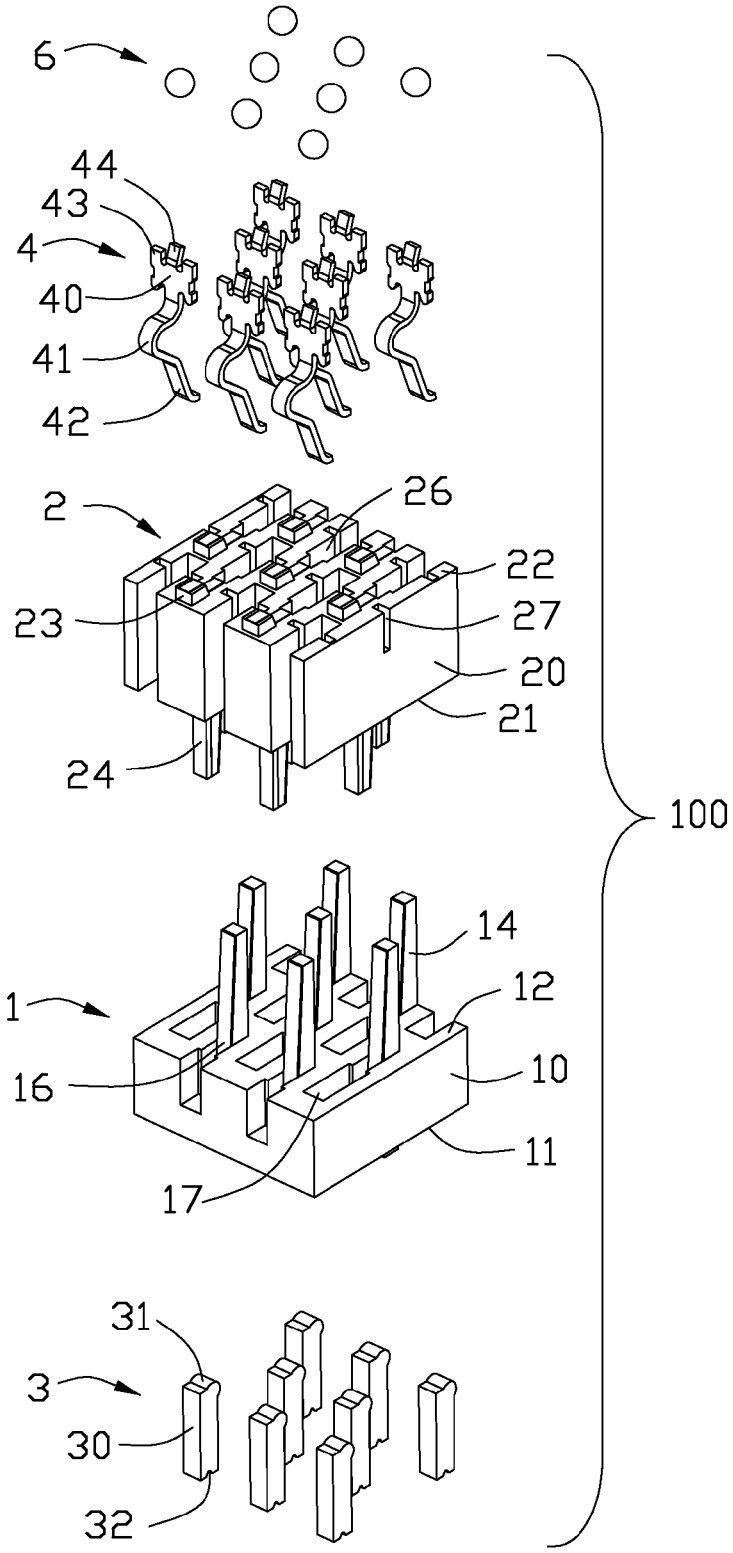
FIG. 6 is another exploded view of the electrical connector as shown in FIG. 5.

Referring to FIGS. 5-6, each of the upper terminals 3 comprises a main body 30 and a projecting portion 31 extending downwardly and outwardly from the main body 30 to electrically connecting with the lower terminal 4. The projection portion 31 is configured with arc shape and is about half of the cylindrical. The top of the main body 30 has a V-cut 32 to connect with the chip module stably. Each of the lower terminals 4 comprises a base portion 40, a bending portion 41 extending upwardly and outwardly from one side of the base portion 40 and a spring beam 42 extending upwardly and outwardly from the bending portion 41. Each of the lower terminals 4 also comprises a soldering portion 44 extending downwardly from the base portion 40 and a pair of retention portions 43 extending downwardly from two sides of the base portion 40. The retention portion 43 is secured in the retention slot 27. The solder balls 6 are received in the lower receiving slots 26 respectively and are fixed in the second base 20 by the soldering portion 44 and the sidewall of the lower receiving slot 26.

The first solder balls 7 are assembled on the first tabs 13 respectively and are electrically connected with the metal layer 5 plated on the first tab 13. The second solder balls 8 are assembled on the third tabs 23 respectively and are electrically connected with the metal layer 5 plated on the third tab 23. Thus, the electrical contacting of the metal layer 5 and the first solder balls 7, the second solder balls 8 electrical connects the chip module, the electrical connector 100 and the printed circuit board, so as to provide a route for communicating the electromagnetic shielding and getting better shielding effect.

Figure 7:
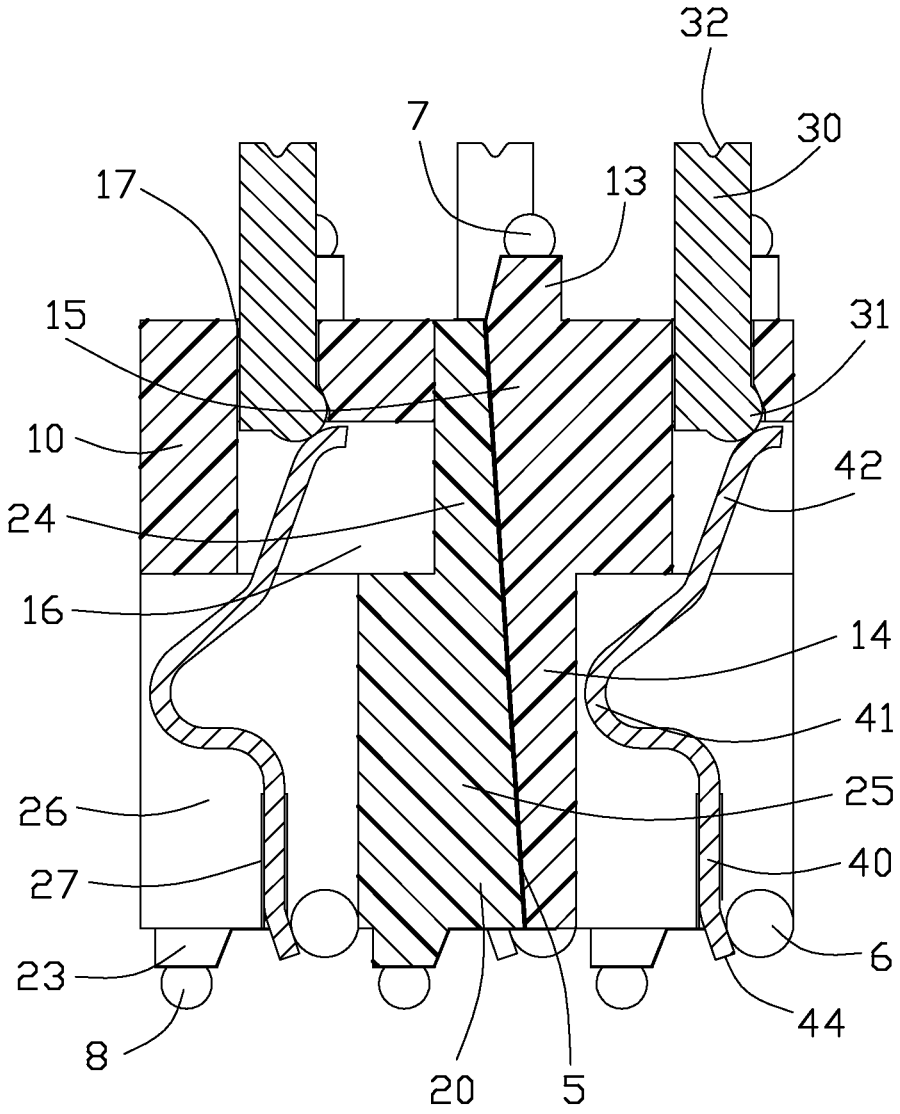
FIG. 7 is a cross-sectional view of the electrical connector with a plurality of grounding elements taken along line 7-7 in FIG. 1.
Figure 8:
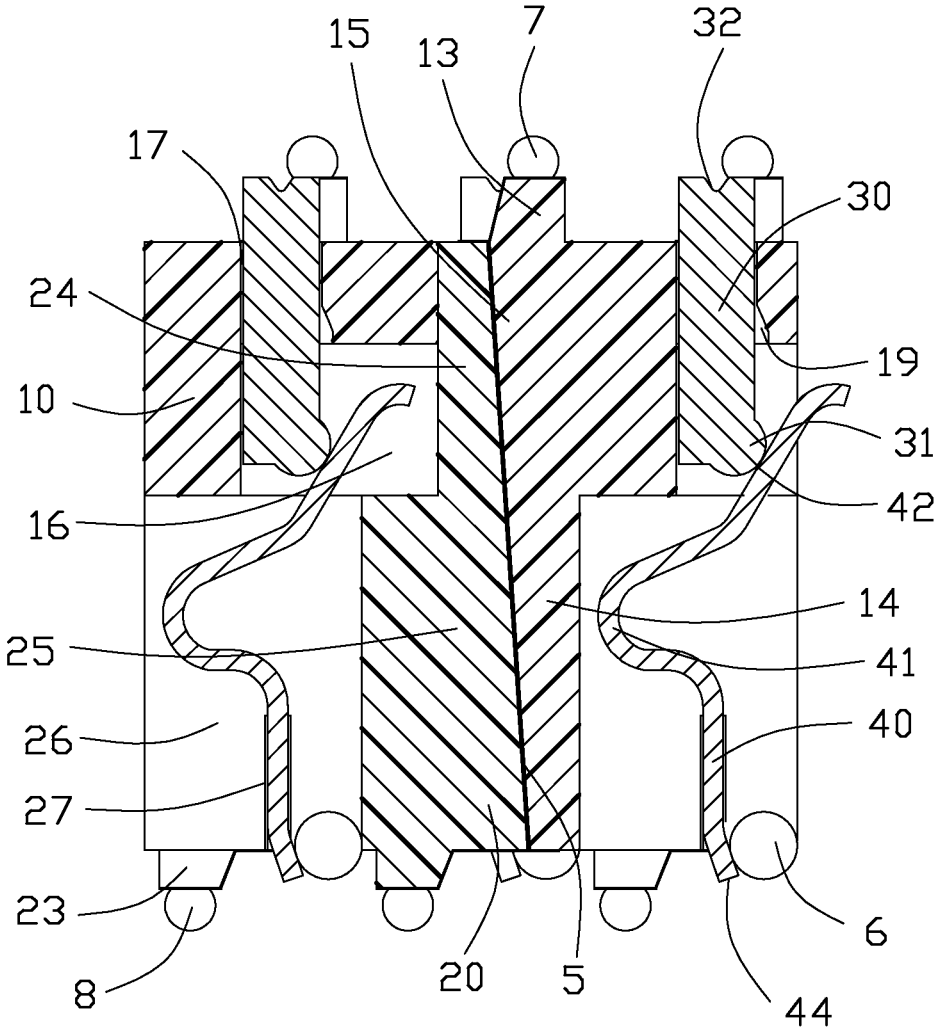
FIG. 8 is similar to FIG. 7 showing the lower terminals are pressed.

Referring to FIGS. 7-8, after the electrical connector 100 is assembled, the upper component 1 is stacked on the lower component 2, the second tab 14 is received in the lower receiving slot 26 and the fourth tab 24 is received in the receiving hole 18. An area that the upper tab contacts with the lower tab is plated with the metal layer 5. The upper tab and the lower tab are wedge-shape that have been reversed. The second tab 14 and the upper connecting portion 15 contact with the fourth tab 24 and the lower connecting portion 25, the contacting area is plated with the metal layer 5. The upper terminal 3 is received in the terminal receiving passageway 17 and it can moves up and down in the terminal receiving passageway 17 and the upper receiving slot 16. The terminal receiving passageway 17 has a receiving portion 19 that receives the projecting portion 31. The lower terminal 4 is fixed in the retention slot 27, the spring beam 42 is received in the upper receiving slots 16 and it can moves in the upper receiving slots 16.

After the chip module is assembled to the electrical connector 100, the upper terminal 3 moves downwardly due to the pressing of the chip module and then the projecting portion 31 slides along the spring beam 42. So, the projecting portion 31 presses the spring beam 42 to make it move downwardly and horizontally. The projecting portion 31 presses the spring beam 42 moving downwardly and also pushes the spring beam 42 of the lower terminal 4 moving in horizontal. Referring to FIG. 8, the upper terminal 3 contacts the lower terminal 4 while the upper terminal 3 has being pressed to a limit state. The projecting portion 31 can prevent the upper terminal 3 being come off from the upper component 1 after the electrical connector has been assembled.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector electrically connecting a chip module to a printed circuit board, and comprising:

an insulative housing;

a plurality of terminals comprising a plurality of upper terminals and a plurality of lower terminals matched with the upper terminals, the upper terminals and the lower terminals are received in the insulative housing; wherein the lower terminal comprises a base portion and a spring beam extending upwardly from the base portion, the upper terminal presses the spring beam of the lower terminal moving downwardly and the upper terminal slides along the spring beam at the same time.

2. The electrical connector as claimed in claim 1, wherein said upper terminal comprises a main body and a projecting portion extending downwardly from the main body and protruding from a side of the main body, the projecting portion presses the spring beam moving downwardly and the projecting portion slides along the spring beam at the same time.

3. The electrical connector as claimed in claim 2, wherein said projecting portion presses the spring beam moving downwardly and also pushes the spring beam of the lower terminal moving in horizontal.

4. The electrical connector as claimed in claim 2, wherein the top of the main body has a V-cut for connecting the chip module stably.

5. The electrical connector as claimed in claim 1, wherein said insulative housing comprises an upper component that has a plurality of upper tabs and a lower component assembled on the upper component that has a plurality of lower tabs.

6. The electrical connector as claimed in claim 5, wherein said upper component comprises a first base and the first base comprises a top surface, a bottom surface opposite to the top surface, a plurality of upper receiving slots depressed from the bottom surface and a plurality of terminal receiving passageways depressed from the top surface, the terminal receiving passageways are communicated with the upper receiving slots respectively.

7. The electrical connector as claimed in claim 6, wherein said first base also comprises a plurality of receiving holes penetrated from the top surface to the bottom surface and the receiving holes are communicated with the upper receiving slots.

8. The electrical connector as claimed in claim 7, wherein said upper tab comprises a first tab protruding from the top surface, a second tab protruding from the bottom surface and an upper connecting portion connected the first tab with the second tab.

9. The electrical connector as claimed in claim 8, wherein an area of the upper connecting portion exposed in the receiving hole is plated with the metal layer, the metal layer extending upwardly to connect with the first tab and extending downwardly to connect with the second tab.

10. The electrical connector as claimed in claim 5, wherein said lower component comprises a second base and the second base comprises an upper surface, a lower surface opposite to the upper surface and a plurality of lower receiving slots penetrated from the upper surface to the lower surface.

11. The electrical connector as claimed in claim 10, wherein the lower tab comprises a third tab protruding from the lower surface, a fourth tab protruding from the lower surface and a lower connecting portion connected the third tab with the fourth tab.

12. The electrical connector as claimed in claim 11, wherein an area of the lower connecting portion exposed in the lower receiving slot is plated with the metal layer, the metal layer extending downwardly to connect the third tab and the metal layer extending upwardly to connect the fourth tab.

13. The electrical connector as claimed in claim 10, wherein said upper terminal is received in the terminal receiving passageway and the upper receiving slot, the lower terminal is received in the upper receiving slot and the lower receiving slot.

14. The electrical connector as claimed in claim 1, wherein said upper tab and the lower tab are wedge-shape that have been reversed.

15. The electrical connector as claimed in claim 1, wherein said electrical connector also comprises an area that the upper tab contacts with the lower tab is plated with a metal layer.

16. An electrical connector comprising:

an insulative lower housing defining a plurality of lower passageways extending therethrough in a vertical direction between two opposite upper and lower surfaces thereof;

a plurality of lower contacts disposed in the corresponding lower passageways, respectively, each of said lower contacts defining, around an upper part thereof, a resilient lower abutment section deflectable in both the vertical direction and a transverse direction perpendicular to said vertical direction;

an insulative upper housing stacked upon the lower housing and defining a plurality of upper passageways extending therethrough, respectively in alignment with the corresponding lower passageways, along the vertical direction between two opposite top and bottom surfaces thereof; and a plurality of upper contacts disposed in the corresponding upper passageways, respectively, each of said upper contacts defining, around a lower part thereof, an upper abutment section constantly abutting against the lower abutment section of the corresponding lower contact; wherein during operation, the upper contact is wholly moved in the upper passageway simply in the vertical direction; a lower part of the lower contact is fixed without movement in the lower passageway while the upper part of the lower contact is moved in the lower passageway in both said vertical direction and said transverse direction.

17. The electrical connector as claimed in claim 16, wherein the upper housing further defines a plurality of projecting posts downwardly extending beyond the bottom surface and into the corresponding lower passageways, respectively; the lower housing further defines a plurality of projecting posts upwardly extending beyond the upper surface and into the corresponding upper passageways and mechanically and electrically connected to the corresponding upper projecting posts, respectively.

18. The electrical connector as claimed in claim 16, wherein the upper abutment section defines an arc shape to comply with vertical and transverse movement of the lower abutment section.

19. An electrical connector comprising:

an insulative lower housing defining a plurality of lower passageways extending therethrough in a vertical direction between two opposite upper and lower surfaces thereof;

a plurality of lower contacts disposed in the corresponding lower passageways, respectively, each of said lower contacts defining a lower abutment section around an upper part thereof;

an insulative upper housing stacked upon the lower housing and defining a plurality of upper passageways extending therethrough, respectively in alignment with the corresponding lower passageways, along the vertical direction between two opposite top and bottom surfaces thereof; and a plurality of upper contacts disposed in the corresponding upper passageways, respectively, each of said upper contacts defining, around a lower part thereof, an upper abutment section constantly abutting against the lower abutment section of the corresponding lower contact; wherein the upper housing further defines a plurality of projecting posts downwardly extending beyond the bottom surface and into the corresponding lower passageways, respectively; the lower housing further defines a plurality of projecting posts upwardly extending beyond the upper surface and into the corresponding upper passageways and mechanically and electrically connected to the corresponding upper projecting posts, respectively.

20. The electrical connector as claimed in claim 19, wherein during operation, the upper contact is wholly moved in the upper passageway; a lower part of the lower contact is fixed without movement to retain a corresponding solder ball while the upper part of the lower contact is moved in the lower passageway.

* * * * *